US011737583B2

(12) United States Patent
McAndrew

(10) Patent No.: US 11,737,583 B2
(45) Date of Patent: Aug. 29, 2023

(54) AIR CURTAIN BLANKING PLATE

(71) Applicant: Aerofoil Energy Limited, Bollington (GB)

(72) Inventor: Paul McAndrew, Cheshire (GB)

(73) Assignee: Aerofoil Energy Limited, Cheshire (GB)

( * ) Notice: Subject to any disclaimer, the term of this patent is extended or adjusted under 35 U.S.C. 154(b) by 651 days.

(21) Appl. No.: 16/302,471

(22) PCT Filed: May 16, 2017

(86) PCT No.: PCT/GB2017/051366

§ 371 (c)(1),
(2) Date: Apr. 8, 2019

(87) PCT Pub. No.: WO2017/199017

PCT Pub. Date: Nov. 23, 2017

(65) Prior Publication Data

US 2019/0274452 A1 Sep. 12, 2019

(30) Foreign Application Priority Data

May 16, 2016 (GB) ..... 1608586

(51) Int. Cl.
*A47F 3/04* (2006.01)
*F24F 9/00* (2006.01)

(52) U.S. Cl.
CPC ..... *A47F 3/0447* (2013.01); *A47F 3/0469* (2013.01); *F24F 9/00* (2013.01); *F24F 2009/005* (2013.01)

(58) Field of Classification Search
CPC ..... A47F 3/0447; A47F 3/0469; F24F 9/00; F24F 2009/005
(Continued)

(56) References Cited

U.S. PATENT DOCUMENTS 2,822,672 A 2/1958 Dickson
3,063,252 A 11/1962 Lamb
(Continued)

FOREIGN PATENT DOCUMENTS

CN 1131383 A 9/1996
CN 1143736 A 2/1997
(Continued)

OTHER PUBLICATIONS

Unknown, JPS62162569 Translation.pdf, "Name of idea freezing and refridgerating open showcase", Oct. 1987, pp. 1-7.*
(Continued)

*Primary Examiner* — Avinash A Savani
*Assistant Examiner* — Ryan L Faulkner
(74) *Attorney, Agent, or Firm* — Cooley LLP

(57) ABSTRACT

An open display refrigerator comprises a refrigerated interior space, air in the refrigerated interior space being separated from air exterior to the open display refrigerator by an air curtain established by a fan which blows air through an air outlet towards a corresponding air inlet which recovers air from the air curtain for recirculation to the air outlet. A distal region of the air outlet is occluded to leave only a region of the air outlet proximal to the interior space open, and an air curtain guide is aligned in a direction of air flow of the air curtain with an edge of the blanking plate proximal to the interior space.

6 Claims, 3 Drawing Sheets

(58) Field of Classification Search
USPC ..... 454/193
See application file for complete search history.

(56) References Cited

U.S. PATENT DOCUMENTS

| | | | | |
|---|---|---|---|---|
| 3,063,253 | A | 11/1962 | Dickson et al. | |
| 3,747,726 | A | 7/1973 | Walter | |
| 4,245,482 | A | 1/1981 | Abraham | |
| 4,807,446 | A * | 2/1989 | Sunaga | A47F 3/0469 62/256 |
| 6,094,931 | A | 8/2000 | Jeong | |
| 8,729,429 | B2 | 5/2014 | Nuttall et al. | |
| 9,370,262 | B2 | 6/2016 | Wirth | |
| D777,225 | S | 1/2017 | McAndrew | |
| D824,963 | S | 8/2018 | McAndrew | |
| D854,590 | S | 7/2019 | McAndrew | |
| 10,966,547 | B2 | 4/2021 | McAndrew et al. | |
| 11,540,650 | B2 | 1/2023 | McAndrew et al. | |
| 2005/0217297 | A1 | 10/2005 | Wilson | |
| 2007/0125109 | A1 | 6/2007 | Morasch | |
| 2007/0251253 | A1* | 11/2007 | Alahyari | A47F 3/0447 62/256 |
| 2008/0205040 | A1 | 8/2008 | Shibusawa et al. | |
| 2008/0236182 | A1 | 10/2008 | Hahn et al. | |
| 2011/0049119 | A1 | 3/2011 | Nuttall et al. | |
| 2012/0092350 | A1 | 4/2012 | Ganapathi et al. | |
| 2013/0019621 | A1* | 1/2013 | Wood | A47F 3/0478 62/126 |
| 2015/0374141 | A1 | 12/2015 | Wirth | |
| 2015/0374142 | A1* | 12/2015 | Wirth | A47F 3/0469 62/251 |
| 2016/0302591 | A1 | 10/2016 | McAndrew | |
| 2018/0325284 | A1 | 11/2018 | McAndrew et al. | |
| 2019/0360738 | A1 | 11/2019 | McAndrew | |

FOREIGN PATENT DOCUMENTS

| | | | |
|---|---|---|---|
| CN | 101014268 | A | 8/2007 |
| CN | 101031225 | A | 9/2007 |
| CN | 101315244 | A | 12/2008 |
| CN | 201167752 | Y | 12/2008 |
| CN | 103017289 | A | 4/2013 |
| CN | 203000146 | U | 6/2013 |
| CN | 204043277 | U | 12/2014 |
| CN | 104776661 | A | 7/2015 |
| DE | 69813806 | T2 | 4/2004 |
| EP | 0441357 | A2 | 8/1991 |
| EP | 1839535 | A2 | 10/2007 |
| EP | 2735826 | A1 | 5/2014 |
| FR | 2690825 | A1 | 11/1993 |
| GB | 2527636 | A | 12/2015 |
| GB | 2541996 | A | 3/2017 |
| JP | S5072330 | A | 6/1975 |
| JP | S51150569 | U | 12/1976 |
| JP | S5374768 | U | 6/1978 |
| JP | S55165468 | A | 12/1980 |
| JP | S57152073 | U | 9/1982 |
| JP | S58110977 | A | 7/1983 |
| JP | S59174588 | U | 11/1984 |
| JP | S62162569 | U | 10/1987 |
| JP | S6360871 | U | 4/1988 |
| JP | H07218093 | A | 8/1995 |
| JP | 2004278865 | A | 10/2004 |
| JP | 2009-222290 | A | 10/2009 |
| JP | 2010207564 | A | 9/2010 |
| JP | 2010207565 | A | 9/2010 |
| JP | 2011131036 | A | 7/2011 |
| JP | 2011167384 | A | 9/2011 |
| JP | 2012231826 | A | 11/2012 |
| JP | 2014198069 | A | 10/2014 |
| WO | WO-2012112115 | A1 | 8/2012 |
| WO | WO-2014167320 | A1 | 10/2014 |

OTHER PUBLICATIONS

International Search Report and Written Opinion for International Application No. PCT/GB2017/051366 dated Aug. 9, 2017, 13 pages.
Office Action issued in European Application No. 17 724 435.7 dated Apr. 16, 2020, 4 pages.
Office Action issued in European Application No. 17 724 435.7 dated Feb. 12, 2021, 4 pages.
Search Report for United Kingdom Application No. GB1608586.2 dated Nov. 1, 2016, 1 page.
Office Action issued in Chinese Application No. 201780018630.3 dated Jul. 18, 2020, 16 pages.
Office Action issued in Chinese Application No. 201780018630.3 dated Jun. 18, 2021, 8 pages.
Office Action issued in Japanese Application No. JP 2018-560623 dated Jul. 6, 2021, 16 pages.
Office Action issued in Chinese Application No. 201780018630.3 dated Mar. 9, 2021, 7 pages.
Search Report issued in Chinese Application No. 201780018630.3 dated Sep. 22, 2021, 3 pages.
Examination Report, dated Mar. 11, 2022, for Australian Patent Application No. 2017265919 (5 total pages).
Examination Report, dated Mar. 10, 2017, for United Kingdom Application No. GB1608586.2 (3 total pages).
Examination Reported, dated May 30, 2017, for United Kingdom Application No. GB1608586.2 (4 total pages).
Examination Reported, dated Aug. 24, 2017, for United Kingdom Application No. GB1608586.2 (3 total pages).
Office Action, dated Aug. 12, 2019, for Chilean Application No. 201803091 (14 total pages).
Office Action, dated Jan. 15, 2020, for Chilean Application No. 201803091 (12 total pages).
Office Action, dated Mar. 15, 2021, for Chilean Application No. 202001033, with English translation (23 total pages).
First Office Action, dated Jun. 18, 2020, for Chinese Patent Application No. 201780018630.3, with English translation (13 total pages).
Walker, D., et al, (Dec. 2004) "Investigation of Energy-Efficient Display Cases," Oak Ridge National Laboratory, U.S. Department of Energy (164 total pages).
Office Action issued for European Patent Application No. 17724435.7, dated Feb. 6, 2023, 5 pages.

* cited by examiner

AIR CURTAIN BLANKING PLATE

CROSS REFERENCE TO RELATED APPLICATIONS

This application is a U.S. National Stage Entry and claims priority under 35 U.S.C. § 371 of International Patent Application No. PCT/GB2017/051366 entitled "Improvements to Open Display Refrigerators," filed May 16, 2017, which is hereby incorporated by reference in its entirety. International Patent Application No. PCT/GB2017/051366 claims priority to United Kingdom Patent Application No. 1608586.2, filed May 16, 2016.

TECHNICAL FIELD

The invention relates to open display refrigerators and to methods of modifying open display refrigerators.

BACKGROUND

Open display refrigerators are commonly used in retail environments, such as supermarkets, to store and display products, such as meat and dairy products, which must be kept at lower than ambient temperatures. The open front of such a refrigerator makes it easy for customers to view the products being displayed and to retrieve products they wish to purchase from the refrigerator.

This type of refrigerator has an air curtain, which is established by blowing cold air across the front of the refrigerator. The air curtain issues from an air outlet at the top of the refrigerator towards an air inlet at the bottom of the refrigerator. The air inlet recovers air from the air curtain and recirculates it to the air outlet via a cooling heat exchanger and fan.

The air curtain prevents cold air in the refrigerator from mixing with warm air exterior to the refrigerator. However, it is rather inefficient, in particular because the air curtain tends to spill out from the bottom of the refrigerator and warm air from the exterior becomes entrained into the air curtain. To ameliorate this problem of inefficiency, there have recently been developments in controlling the air curtain to prevent the entrainment of warm air. One technique is the use of aerofoils fixed on the front edge of shelves in the refrigerator to help constrain the air curtain within a desired region.

To work effectively, the aerofoils need to be in reasonably good alignment with an outer edge of the air curtain. In some refrigerator designs, for example those having a deep air outlet, this can result in there being a large gap between the front edge of the shelves and the aerofoils. Large gaps are obtrusive to shoppers and staff. Furthermore, the brackets attaching the aerofoils to the refrigerator need to be longer, rendering them prone to breakage or deformation if, for example, a shopper rests a shopping basket on an aerofoil. These problems can result in retailers electing not to use aerofoils for guiding the air curtain on their refrigerators, and the efficiency gains available by their use are not achieved.

SUMMARY

In accordance with a first aspect of the invention, there is provided an open display refrigerator comprising a refrigerated interior space, air in the refrigerated interior space being separated from air exterior to the open display refrigerator by an air curtain established by a fan which blows air through an air outlet towards a corresponding air inlet which recovers air from the air curtain for recirculation to the air outlet, wherein a distal region of the air outlet is occluded to leave only a region of the air outlet proximal to the interior space open, and an air curtain guide is aligned in a direction of air flow of the air curtain with an edge of the blanking plate proximal to the interior space.

In a typical situation, the refrigerated interior space houses one or more shelves.

In accordance with a second aspect of the invention, there is provided an open display refrigerator comprising a refrigerated interior space housing a shelf, air in the refrigerated interior space being separated from air exterior to the open display refrigerator by an air curtain established by a fan which blows air through an air outlet towards a corresponding air inlet which recovers air from the air curtain for recirculation to the air outlet, wherein a proximal region of the air outlet is occluded to leave only a region of the air outlet distal from the interior space open, an air curtain guide aligned in a direction of air flow of the air curtain with an edge of the air outlet distal from the interior space, and the shelf is disposed such that a gap between an edge of the shelf adjacent the air curtain guide and the air curtain guide is lower than a predetermined threshold.

In the second aspect, the edge of the shelf adjacent the air curtain guide may lie underneath the proximal region of the air outlet. Alternatively, the edge of the shelf adjacent the air curtain guide may lie within the air curtain.

Unless specifically mentioned otherwise, the optional features described in the following paragraphs may relate to open display refrigerators according to either the first or the second aspect of the invention.

The air outlet normally spans transversely across the entire width of the interior space. This ensures that the air curtain similarly spans across the entire width of the interior space. A blanking plate may be used to occlude the distal region (in the first aspect) or proximal region (in the second aspect) of the air outlet. The blanking plate preferably spans transversely across the width of the air outlet to provide effective occlusion.

Typically, the interior space of the open display refrigerator houses one or more shelves. The or each shelf will usually have a respective air curtain guide, which may be affixed to a casing of the refrigerator or to an edge of the shelf facing outwardly from the interior space. An air curtain guide may be affixed to leave a gap between the air curtain guide and the shelf.

In a preferred embodiment, the air curtain guide is in the form of an aerofoil. A typical design of aerofoil that can be used is a cambered aerofoil. This will usually be oriented with the leading edge uppermost and the cambered surface facing away from the interior space.

The air curtain guide is aligned in a direction of air flow of the air curtain with an edge of the blanking plate proximal to the interior space (in the first aspect of the invention) or it is aligned in a direction of air flow of the air curtain with an edge of the air outlet distal from the interior space (in the second aspect of the invention). The degree of alignment is not overly critical. It is usually enough that the air curtain guide lies on or across the boundary between the air curtain and air exterior to the open display refrigerator.

However, in the case where the air curtain guide is an aerofoil, it is preferred that the face of the aerofoil that is proximal to the refrigerated interior space (i.e. the pressure surface of the aerofoil) should lie on or across the boundary between the air curtain and air exterior to the open display refrigerator. In other words, in this preferred variant, the face of the aerofoil that is proximal to the refrigerated interior space is at least partially aligned in a direction of air flow of the air curtain with an edge of the blanking plate proximal to the interior space (in the first aspect of the invention) or is at least partially aligned in a direction of air flow of the air curtain with an edge of the air outlet distal from the interior space (in the second aspect of the invention).

Since precise alignment is not critical, another possibility is that the aerofoil can lie across leading edge of the aerofoil can lie across the boundary between the air curtain and air exterior to the open display refrigerator. In this variant, a portion of the leading edge of the aerofoil is aligned in a direction of air flow of the air curtain with an edge of the blanking plate proximal to the interior space (in the first aspect of the invention) or is aligned in a direction of air flow of the air curtain with an edge of the air outlet distal from the interior space (in the second aspect of the invention). Thus, the pressure surface of the aerofoil will lie within the air curtain, whereas the suction surface will lie beyond the air curtain in air exterior to the open display refrigerator.

The air outlet may incorporate a cellular matrix of channels extending in a longitudinal direction parallel to the air flow of the air curtain.

When a blanking plate is used in a vertical orientation to occlude the distal region of the air outlet (as may occur in the first aspect of the invention), the cellular matrix of channels may be supported along one edge by resting on a flange of the blanking plate.

In accordance with a third aspect of the invention, a kit comprises a blanking plate for occluding a region of an air outlet in an open display refrigerator as defined in either of the first or second aspects of the invention and at least one air curtain guide for affixing to an open display refrigerator as defined in either of the first or second aspects of the invention.

The kit may further comprise a cellular matrix of channels for incorporation in the air outlet of an open display refrigerator as defined in accordance with the first or second aspect of the invention.

In accordance with a fourth aspect of the invention, a kit comprises a blanking plate for occluding a region of an air outlet in an open display refrigerator as defined in either of the first or second aspects of the invention and a cellular matrix of channels for incorporation in the air outlet of an open display refrigerator as defined in either of the first or second aspects of the invention.

In accordance with a sixth aspect of the invention, there is provided a method of modifying an open display refrigerator comprising a refrigerated interior space, in which air in the refrigerated interior space is separated from air exterior to the open display refrigerator by an air curtain established by a fan which blows air through an air outlet towards a corresponding air inlet which recovers air from the air curtain for recirculation to the air outlet, the method comprising occluding a distal region of the air outlet to leave only a region of the air outlet proximal to the interior space open, and aligning an air curtain guide in a direction of air flow of the air curtain with an edge of the blanking plate proximal to the interior space.

In accordance with a seventh aspect of the invention, there is provided a method of modifying an open display refrigerator comprising a refrigerated interior space housing a shelf, in which air in the refrigerated interior space is separated from air exterior to the open display refrigerator by an air curtain established by a fan which blows air through an air outlet towards a corresponding air inlet which recovers air from the air curtain for recirculation to the air outlet, the method comprising occluding a proximal region of the air outlet to leave only a region of the air outlet distal from the interior space open, aligning an air curtain guide such that the air curtain guide is aligned in a direction of air flow of the air curtain with an edge of the air outlet distal from the interior space, and disposing the shelf such that a gap between an edge of the shelf adjacent the air curtain guide and the air curtain guide is lower than a predetermined threshold.

The method of the seventh aspect may further comprise disposing the shelf such that the edge of the shelf adjacent the air curtain guide lies underneath the proximal region of the air outlet. Alternatively, it may further comprise disposing the shelf such that the edge of the shelf adjacent the air curtain guide lies within the air curtain.

The method according to either of the sixth or seventh aspects of the invention may further comprise incorporating a cellular matrix of channels extending in a longitudinal direction, wherein the longitudinal direction is parallel to the air flow of the air curtain in the air outlet.

The method may further comprise measuring an initial velocity of air in the air curtain prior to occluding the distal or proximal region of the air outlet; and selecting the cellular matrix of channels from a plurality of available cellular matrices, each of which has channels with a respective size transverse to the longitudinal direction, wherein the selection is made such that a final velocity of air in the air curtain is closest to and/or lower than the initial velocity.

This is generally desirable because the act of narrowing the air outlet by way of the blanking plate tends to increase the air velocity in the air curtain beyond the initial velocity. This can be controlled by increasing the size of the channels transverse to the air flow of the air curtain, for example compared to those in a cellular matrix originally fitted to the refrigerator. As an example, where a cellular matrix of hexagonal channels is used, the distance between opposing faces of the hexagonal channels may be increased from 4 mm to 6-8 mm when the air outlet is reduced in size from 100 mm to 50 mm. In other words, when the air outlet is reduced in size in this way, the size of the channels transverse to the air flow of the air curtain may be selected to be in the range of 6 mm to 8 mm (for example, between opposing faces of hexagonal channels in the cellular matrix) to control the air velocity such that restored to a value that is the closest possible (based on the range of available sizes of channel in the cellular matrices) and/or lower than the initial velocity. A typical range of sizes for cellular matrices of hexagonal channels is from 3 mm to 8 mm between opposing faces of the hexagonal channels, although larger or smaller sizes may be available.

The initial velocity can be measured using an anemometer held in the air curtain before the modification of the open display refrigerator (i.e. prior to occluding the proximal or distal region of the air outlet and prior to removal of an existing cellular matrix). After occlusion of the proximal or distal region, a cellular matrix with larger channels (in the transverse direction) than the existing cellular matrix can be selected to restore the air velocity in the air curtain as close as possible to (based on the range of available sizes of channel in the cellular matrices) and/or lower than the initial velocity. This selection can be done empirically without any particular difficulty because the number of available sizes of channel available is limited; of course experience with modification of a particular model of refrigerator can also guide the selection. The final velocity in the air curtain can be checked with an anemometer to confirm it is acceptable.

DETAILED DESCRIPTION

Figure 1:
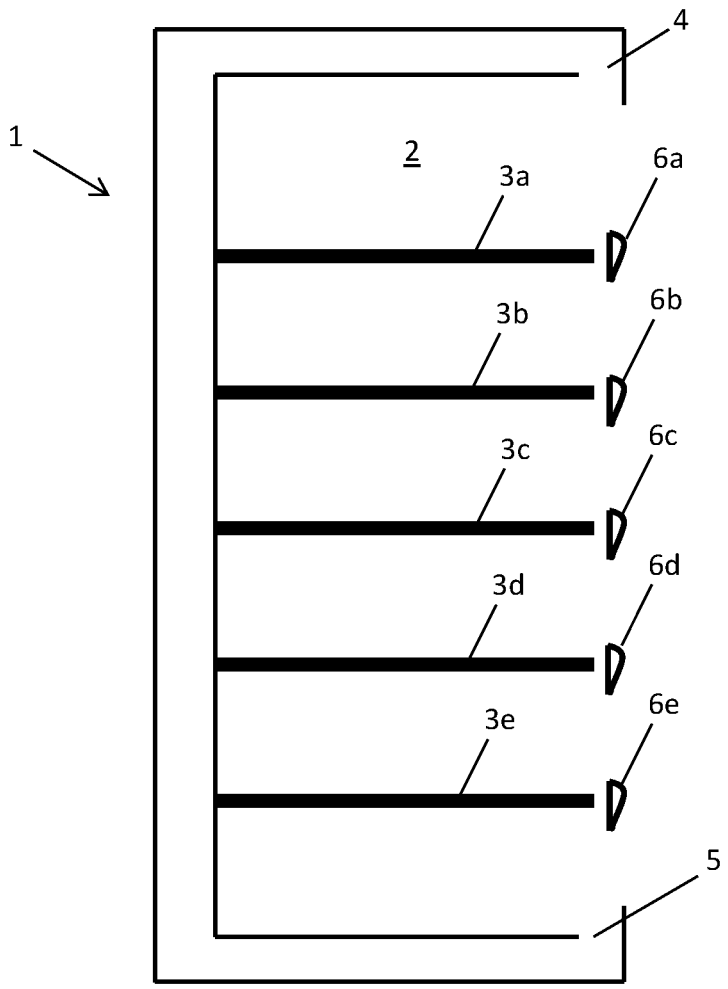
FIG. 1 shows an open display refrigerator with which the invention could be used.

FIG. 1 shows a cross-section through an open display refrigerator 1. The refrigerator has an interior space 2 that is maintained at a lower than ambient temperature. Within the interior space 2, there are five shelves 3*a*-3*e*. The refrigerator 1 establishes an air curtain by blowing cold air from an air outlet 4 towards an air inlet 5. Air inlet 5 recovers air from the air curtain and a fan (not shown) within the refrigerator 1 recirculates the air to the air outlet 4. A cooling unit (not shown) within the refrigerator 1 maintains the recirculated air (and hence the air blown through the air outlet 4 to form the air curtain) at a desired temperature. The desired temperature is chosen to be lower than ambient and acts to prevent cold air in the interior space 2 from mixing with warm air exterior to the refrigerator.

Also shown in FIG. 1 are aerofoils 6*a*-6*e*, each of which is fitted to the front edge of a respective one of shelves 3*a*-3*e*. As explained previously, these assist in constraining the air curtain to the desired path and prevent warm air exterior to the refrigerator 1 from being entrained into the air curtain. In this case, the air curtain runs vertically from the air outlet 4 to the air inlet 5. The aerofoils are thus aligned vertically beneath an outer edge of the air outlet 4. More generally, they will be aligned to be parallel with the direction that the air curtain is intended to follow as it runs from the air outlet 4 to the air inlet 5 and roughly coincident with the outer edge of the air curtain.

In FIG. 1, the situation is acceptable because the air outlet 4 is relatively narrow. This allows the shelves 3*a*-3*e* to project far enough without interfering with the air curtain. The gap between the shelves 3*a*-3*e* and the aerofoils 6*a*-6*e* is therefore low. In the remaining figures, FIG. 2 to FIG. 5, a deeper air outlet is used. The shelves are shorter to avoid interference with the air curtain and there would be an unacceptable gap between the front edge of the shelves 3*a*-3*e* and the aerofoils 6*a*-6*e* if these were maintained in the same position as in FIG. 1.

Figure 2:
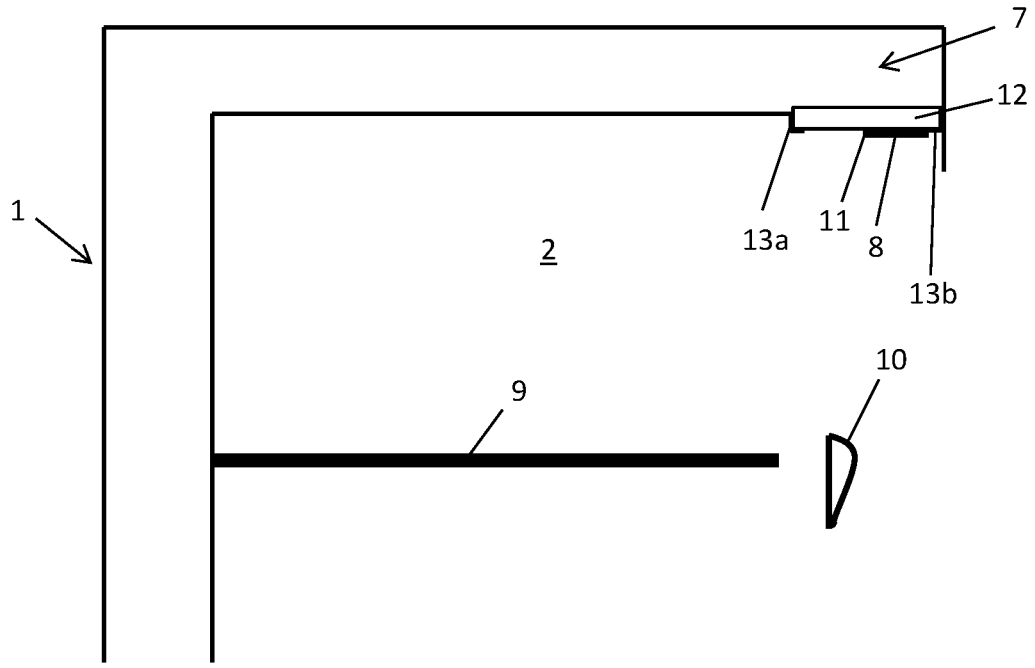
FIG. 2 shows a detailed view of the air outlet in an open display refrigerator according to a first embodiment of the invention.

FIG. 2 shows a first solution to the problem. Only the top portion of the refrigerator is shown. In FIG. 2, the air outlet 7 is partially occluded by a blanking plate 8 lying in a horizontal orientation. The blanking plate 8 may be a simple sheet of metal or plastic that extends across the full width of the air outlet 7. The blanking plate 8 occludes a region of the air outlet 7 that is distal from the interior space 2. The region of the air outlet 7 that is proximal to the interior space 7 is left open. In other words, it is in fluid communication with the interior space 2 so that the air curtain can flow through the proximal region.

A shelf 9, which does not project so as to interfere with the air curtain, has an aerofoil 10 affixed to its front edge by way of brackets (not shown). The aerofoil 10 is aligned with an edge 11 of the blanking plate 8 that is closest to the interior space 2. Thus, as with the situation in FIG. 1, the aerofoil 10 is aligned with the outer edge of the air curtain.

A cellular matrix 12 of channels is provided in the air outlet 7 such that the air must pass through the channels to form the air curtain. This can be used to direct the air curtain in the desired direction (in this case, vertically) and to control the air velocity. In this case, the size of the channels is chosen to keep the air velocity in the air curtain as close as possible to and/or lower than an initial velocity of the air curtain. The initial velocity of the air curtain is measured with an anemometer prior to modification of the refrigerator by fitting the blanking plate. In practice, the cellular matrix 12 is chosen from a range of available matrices to restore the air velocity as closely as can be achieved to its initial value. The chosen matrix will have channels that are wider than those of any originally fitted cellular matrix, which of course would be removed during the modification of the refrigerator. Without the cellular matrix 12, the air velocity would increase as a result of the air outlet being effectively reduced in depth by the fitting of the blanking plate 8. The cellular matrix is supported on flanges 13*a* and 13*b*. The presence of the cellular matrix 12 allows the blanking plate 8 to be fitted by screwing it to the cellular matrix 12.

Figure 3:
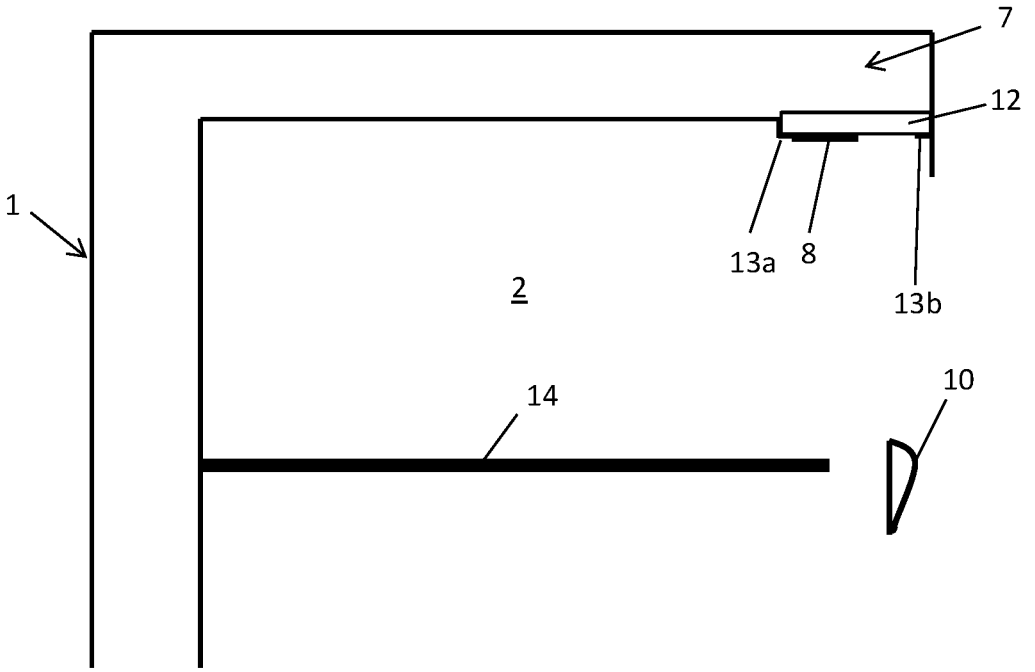
FIG. 3 shows a detailed view of the air outlet in an open display refrigerator according to a second embodiment of the invention.

In FIG. 3, the blanking plate 8 is fitted to the region of the air outlet 7 that is proximal to the interior space 2. The region of the air outlet 7 distal from the interior space 2 is left open. As can be seen, the arrangement of air outlet 7, blanking plate 8 and cellular matrix 12 is otherwise identical to that shown in FIG. 2. This arrangement allows a deeper shelf 14 to be fitted, the outer edge of which lies underneath the blanking plate 8. The aerofoil 10 is aligned with the outer edge of the air outlet 7 without leaving an unacceptably large gap between the shelf 14 and the aerofoil 10.

Figure 4:
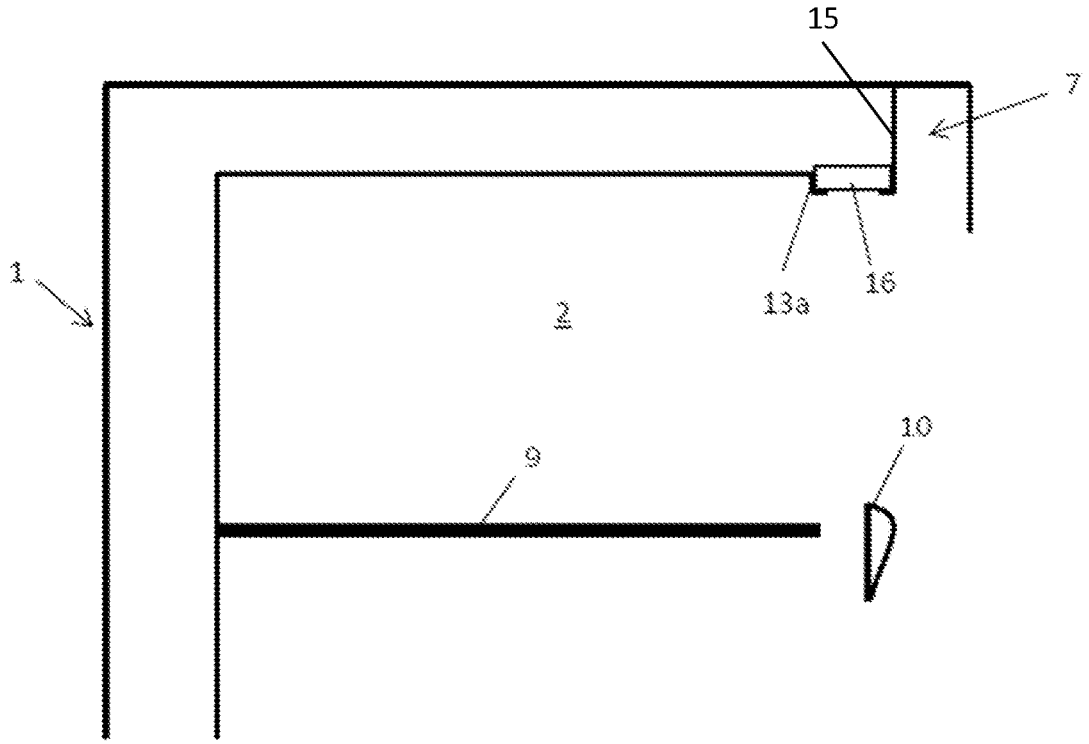
FIG. 4 shows a detailed view of the air outlet in an open display refrigerator according to a third embodiment of the invention.
Figure 5:
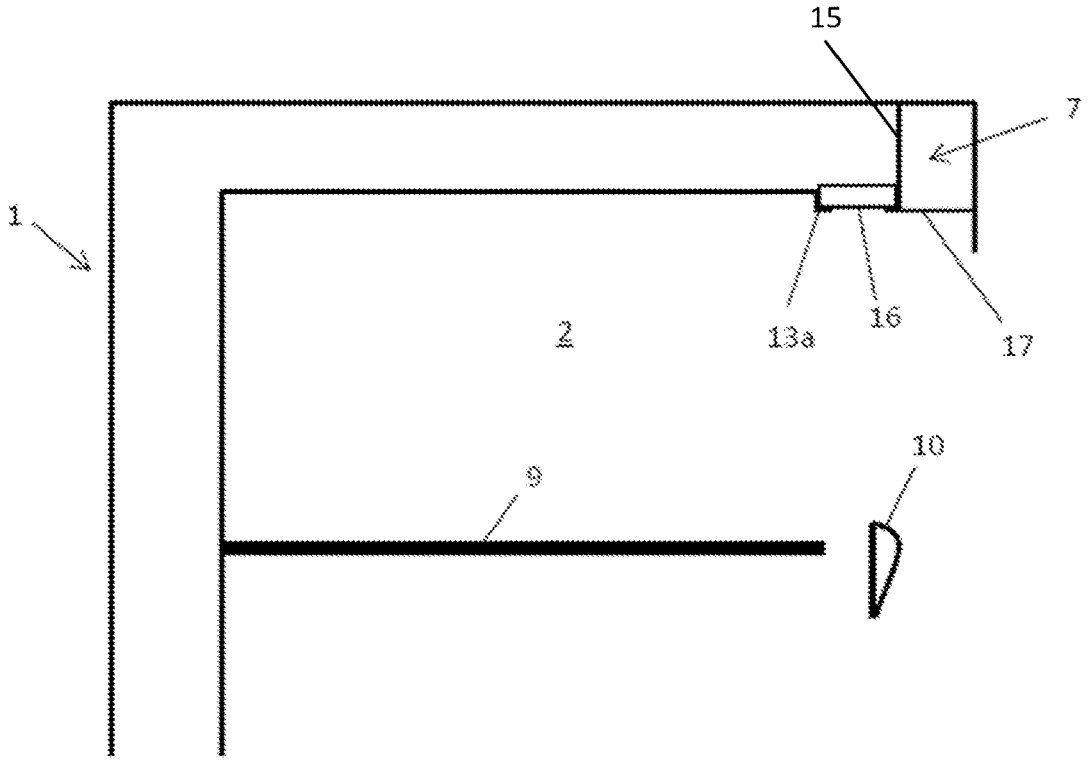
FIG. 5 shows a detailed view of the air outlet in an open display refrigerator according to a fourth embodiment of the invention.

FIG. 4 shows another solution, in which a vertically oriented blanking plate 15 occludes the region of the air outlet 7 distal from the interior space 2. The blanking plate 15 may be L-shaped, one part of the L-shaped plate being fixed (for example, by screws) to the top wall of the refrigerator above air outlet 7, thereby leaving the other part of the L-shaped plate depending vertically as is shown in FIG. 4. The same shelf 9 as shown in FIG. 2 is used in FIG. 4 and the aerofoil 10 is in the same position, aligned with the outer edge of the air curtain. The cellular matrix 16 that is used is narrower than in FIGS. 2 and 3. It is supported by flange 13*a* and by a flange 17 on the blanking plate 15. A minor variation is shown in FIG. 5, in which the flange 17 extends either side of the vertical part of blanking plate 15 to meet the front wall of the refrigerator 1. This allows a more rigid attachment of the blanking plate 15.

The invention claimed is:

1. A method, comprising:

measuring a first velocity of an air curtain flowing through a first cellular matrix of air channels and emanating from an air egress of an open display refrigerator;

removing the first cellular matrix of air channels from the air egress after measuring the first velocity;

occluding a portion of the air egress with a blanking plate after measuring the first velocity to create a partially occluded air egress with a cross-sectional area that is smaller than the air egress before the portion of the air egress was occluded; and installing a second cellular matrix of air channels different from the first cellular matrix after occluding the portion of the air egress, the second cellular matrix configured such that the air curtain emanating from the partially occluded air egress and passing through the second cellular matrix of air channels has a second velocity equal to or lower than the first velocity.

2. The method of claim 1, wherein an outer edge of the air curtain emanating from the partially occluded air egress is aligned with an air curtain guide coupled to a shelf.

3. The method of claim 1, wherein, prior to occluding the portion of the air egress, an outer edge of the air curtain emanating from the air egress is distal to an air curtain guide coupled to a shelf.

4. The method of claim 1, further comprising aligning an air curtain guide with an outer edge of the air curtain after occluding the portion of the air egress.

5. The method of claim 1, wherein the second cellular matrix defines a second plurality of channels, each of which is larger than a channel from a first plurality of channels defined by the first cellular matrix.

6. The method of claim 1, wherein the second cellular matrix replaces the first cellular matrix.

* * * * *